United States Patent [19]

Agbay

[11] Patent Number: 4,513,592

[45] Date of Patent: Apr. 30, 1985

[54] BARREL LOCK

[75] Inventor: Anthony J. Agbay, Auburn, Mass.

[73] Assignee: Omco Inc., Holden, Mass.

[21] Appl. No.: 547,406

[22] Filed: Oct. 31, 1983

[51] Int. Cl.[3] ..... E05B 67/36

[52] U.S. Cl. ..... 70/34; 70/38 C

[58] Field of Search ..... 70/14, 32, 33, 34, 23, 70/386, DIG. 54, DIG. 55

[56] References Cited

U.S. PATENT DOCUMENTS

| | | | |
|---|---|---|---|
| 1,923,025 | 8/1933 | Morse | 70/34 |
| 3,002,368 | 10/1961 | Moberg | 70/14 |
| 3,835,674 | 9/1974 | Hoyt | 70/34 |
| 4,040,279 | 8/1977 | Signorelli | 70/34 |
| 4,441,343 | 4/1984 | Nielsen | 70/34 |

*Primary Examiner*—Robert L. Wolfe

*Attorney, Agent, or Firm*—Thompson, Birch, Gauthier & Samuels

[57] ABSTRACT

A barrel lock has a cylindrical barrel with an axial bore. A compression spring and a center pin are coaxially mounted in the bore. A pair of locking balls mounted for limited movement in radially extending passageways are held radially outward in a locking position by the compression spring. When a key for locking and unlocking the lock is fully inserted into the lock and the key handle is operated, the compression spring is drawn rearwardly and the locking balls are permitted to move radially inward to an unlocking position.

13 Claims, 3 Drawing Figures

BARREL LOCK

BACKGROUND OF THE INVENTION

Prior art barrel locks and keys are shown in U.S. Pat. Nos. 1,923,025; 3,002,368; 3,835,674; and 4,040,279. The disclosures of these patents are incorporated herein by reference and made a part of the present disclosure. These prior art locks and keys have become increasingly less secure with the passage of time because of the relatively wide, albeit substantially controlled, distribution and use of the keys by a large number of people. Assignee's copending U.S. Pat. No. 4,441,343, the disclosure of which is incorporated herein by reference, described one approach to overcoming this problem.

It is the object of this invention to provide a barrel lock which cannot be opened with a conventional key or with picks or nails.

SUMMARY OF THE INVENTION

The barrel lock of this invention is similar in many respects to the prior art locks. However, in the present invention, a compression spring and a center pin are coaxially mounted within an axial bore in the lock barrel. A pair of locking balls mounted for limited movement in radially extending passageways are held radially outward in a locking position by the compression spring.

The key described herein is specifically designed to open the barrel lock of this invention and is similar to the prior art keys. The key is inserted into the lock of this invention whose locking balls are normally in the locking position. When the key handle is operated, the compression spring is retracted by the outward and rearward movement of the key's expanding fingers. This action permits the locking balls to move radially inward to their unlocking position and the unlocked lock can then be withdrawn entirely.

DESCRIPTION OF THE PREFERRED EMBODIMENTS

Figures 1, 2, 3:
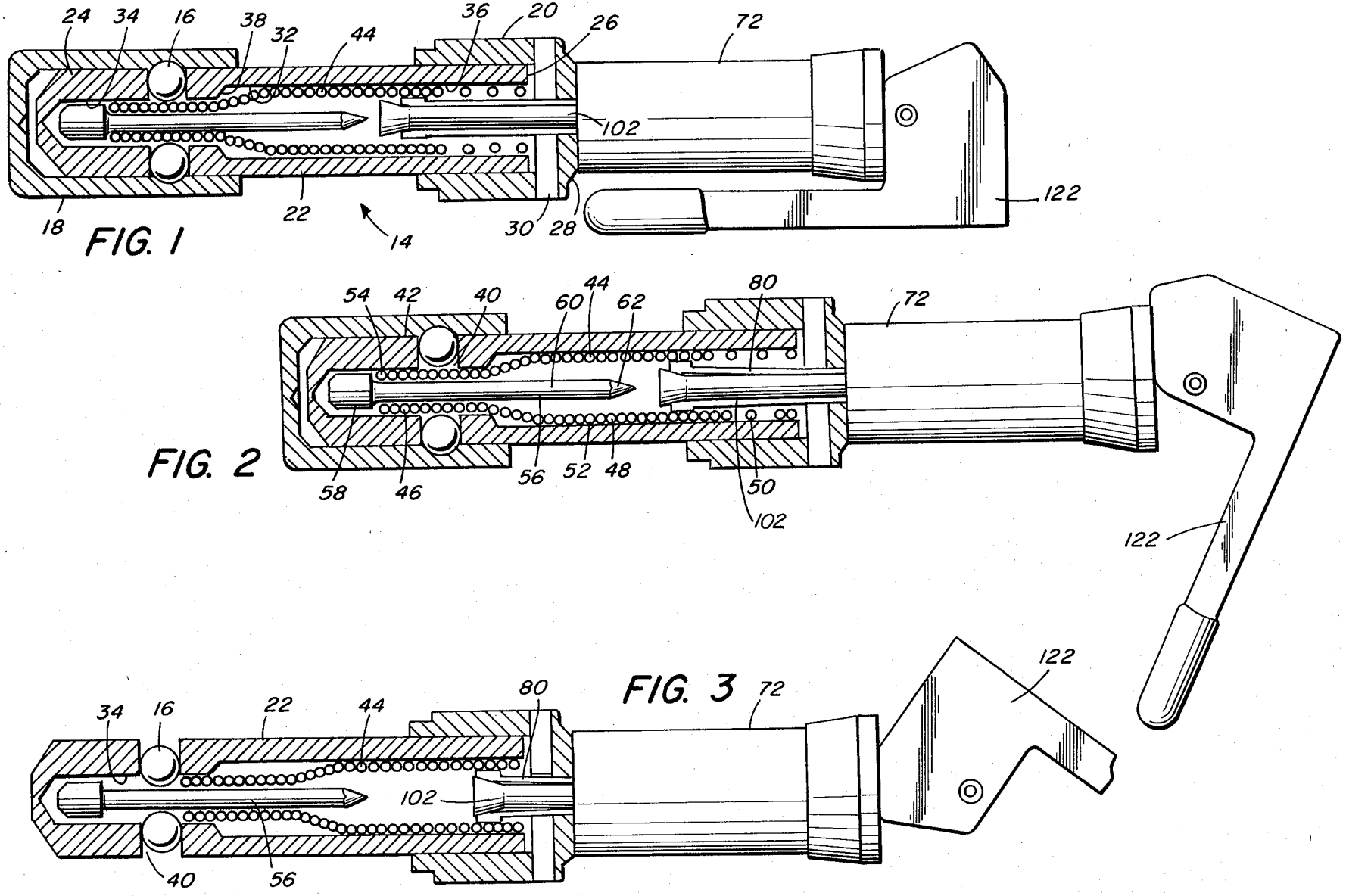
FIG. 1 is a vertical section of the preferred embodiment of the barrel lock of this invention. The lock is shown in its locked condition with the key shown inserted into the barrel lock and with the key handle shown in its first position.
FIG. 2 is a vertical section showing the barrel lock in its locked condition and the key handle has been pivoted to its second position causing the key expanding fingers to fully engage the lock compression spring.
FIG. 3 is similar to FIG. 2 except that the key handle has been pivoted to its third position causing the key expanding fingers to fully retract the lock compression spring, the lock compression spring clearing the locking ball passageway inner apertures. The locking balls have moved radially inward and the barrel lock is now in its unlocked condition and has been longitudinally withdrawn from the front end cap to which it has previously secured.

FIG. 1 shows a barrel lock 14 of the invention in its locked condition wherein its two locking members 16, for example locking balls, have been forced radially outward so that they engage a groove in a front end cap 18. Thus, when barrel lock 14 is in its FIGS. 1 and 2 locked condition, it cannot be longitudinally removed from front end cap 18.

Barrel lock 14 can be used in many situations to lock two elements against various types of relative movement. Front end cap 18 illustrates but one locking situation of the type wherein two unshown apertured flat panels have the lock inserted through and both the two flat panels are prevented from separating by the large rear end cap 20 of the lock on one side and the large front end cap 18 on the other side. There are many other situations in which barrel lock 14 is useful.

Barrel lock 14 has a hollow cylindrical lock barrel 22 which has a closed front end 24 and an open rear end 26. Rear end cap 20 is fitted over and fixed to open rear end 26 enlarging its effective outer diameter and creating an apertured rear end 28 with a selected aperture size. A transverse passage 30 is also provided to accommodate a conventional "tell tale" or lead seal used to signal tampering.

The barrel lock barrel 22 has a stepped axially extending bore 32 including a front small diameter bore 34 and a rear large diameter bore 36. The diameters are small and large relative to each other. The front bore 34 is joined to the rear bore 36 by an annular shoulder 38, the surface of which extends at an angle to the axis of the barrel bore 32.

The lock barrel 22 also has two radially extending passageways 40 which run from the exterior surface 42 of the barrel to the front bore 34 of the lock barrel. The locking balls 16, for example steel locking balls, are movably mounted in the passageways 40 and are free to move radially within the passageways. At the outer aperture of each passageway, a very small inwardly extending peripheral rim is provided which prevents the locking balls 16 from completely escaping outwardly. However, almost half of the locking ball can project outwardly from the passageway as can be seen from FIGS. 1 and 2.

A compression spring 44 having a narrow forward neck portion 46 and an enlarged rear body portion 48, is sized, shaped and mounted to reciprocate within the stepped barrel bore 32. The front narrow neck portion 46 of compression spring 44 slidably fits within the front bore 34 of the barrel 22, and the rear enlarged body portion 48 slidably fits within the rear bore 36 of the barrel 22. The rear body portion 48 has a compressible open coiled rear end 50 and a noncompressible close coiled central portion 52, the neck portion 46 being close coiled as shown at 54.

A lock center pin 56 is sized, shaped and mounted to be able to move axially within the stepped barrel bore 32 and the narrow neck portion 46 of the compression spring 44. The lock center pin 56 has an enlarged head 58 at its front end and a rearwardly extending shaft 60 that terminates in a point 62 at its rear end. The outer diameter of the enlarged head 58 is slightly less than the inner diameter of front bore 34. The enlarged head 58 is sized, shaped and mounted to have a sliding fit within front barrel bore 34. The center pin shaft 60 extends rearwardly through the narrow neck portion 46. The outer diameter of center pin shaft 60 is just slightly less than the inner diameter of narrow neck portion 46 so that there is a sliding fit therebetween.

In the illustrated embodiment, a friction producing compound is placed in the front bore 34 of barrel 22. In the fully locked position shown in FIG. 1, the center pin enlarged head 58 is frictionally held by the friction producing compound in the front bore 34. Therefore, axial movement of the lock center pin 56 within the bore 32 is yieldingly resisted by the friction producing compound.

The friction producing compound prevents axial movement of the center pin 56 in the barrel bore 32 under all conditions except when the axial force exerted on the center pin is in excess of the frictional retaining force provided by the friction producing compound. Excessive force on the center pin 56 will cause it to move axially in the plunger bore. When an authorized key is used to unlock the barrel lock 22, the friction producing compound exerts sufficient frictional retaining force to prevent axial movement of center pin 56 and to prevent its enlarged head 58 from moving across passageways 40 during authorized unlocking of the lock. When an unauthorized device is forced into bore 32 in an attempt to retract spring 44 and to unlock the barrel lock, the unauthorized device contacts and becomes affixed to the sharply pointed center pin 56. Then, when the unauthorized device retracts compression spring 44, it also retracts center pin 56. This causes the enlarged head 58, in its rearward position, to hold the locking balls 16 radially outward in passageways 40, and to maintain the barrel lock in its locked condition.

As shown in FIGS. 1 and 2, the front exterior portion of neck portion 46 of the compression spring 44 is positioned across and closes the inner apertures of both locking ball passageways 40 when the lock is in its normally locked condition. The compression spring 44 forces both locking balls 16 radially outward to their locking position whenever the compression spring covers the locking ball passageways 40. The combined axial length of the uncompressed compression spring 44 and the enlarged head 58 is greater than the axial length of barrel bore 32 so that the compression spring is in a partially compressed state within barrel bore 32. As shown in FIG. 3, when the compression spring 44 is further compressed by operation of a key 72, its neck portion 46 moves rearwardly and uncovers the passageways 40, and the locking balls move radially inward towards the front barrel bore 34.

FIGS. 1–3 show the sequence of the unlocking steps produced by movement of the key handle 122. FIG. 1 shows the key 72 fully inserted through the apertured rear end 28 of the lock barrel 22. Compression spring 44, in its expanded position, forces the locking balls 16 radially outwardly to their locking position. In FIG. 1, the key handle is in its first position.

FIG. 2 shows the key handle 122 rotated to its second position. The compression spring 44 has not moved at all, but the key expander 102 has moved rearwardly and the key fingers 80 have radially expanded to grip the inner surface of the central portion 52 of the compression spring 44.

FIG. 3 shows the key handle 122 rotated to its third position. The compression spring 44 has now been fully compressed and fully retracted to its rearward position, and the lock center pin 56 remains stationary in its forward position because of the friction producing compound. At this point, the lock becomes unlocked because the compression spring front exterior neck portion 46 has cleared the inner apertures of passageways 40 and the locking balls 16 are free to move inwardly in the passageways until they contact the shaft 60 of the lock center pin 56. The lock shown in FIG. 3 has been unlocked and removed from the front end cap 18.

It will be understood from the drawings that if a prior art key or a pick or a nail were inserted in an improper attempt to unlock barrel lock 14 by compressing and retracting the compression spring 44, the lock center pin 56 would be pulled by the unauthorized device to its rearward position along with the compression spring as the compression spring is retracted. Therefore, when the front exterior neck portion 46 cleared the inner apertures of passageways 40, the enlarged head 58 of the lock center pin 56 would close the inner apertures of passageway 40 and continue to maintain locking balls 16 in their locking position and the barrel lock would remain locked.

The above description obviously suggests many possible variations and modifications of this invention which would not depart from its spirit and scope. It should be understood, therefore, that the invention is not limited in its application to the details of structure specifically described or illustrated and that, within the scope of the appended claims, it may be practiced otherwise than as specifically described or illustrated.

What is claimed is:

1. A barrel lock comprising:

(a) a hollow cylindrical lock barrel having a closed front end and an apertured rear end, said lock barrel having a stepped axially extending bore, a front bore of said stepped bore having a relatively small diameter and a rear bore of said stepped bore having a relatively large diameter;

(b) said stepped barrel bore having an annular shoulder forming the junction between said front bore and said rear bore;

(c) at least two radially extending passageways running from an outer aperture in the exterior surface of said lock barrel to an inner aperture in said front bore of said lock barrel, and a locking member mounted in each said passageway for limited movement therein, said locking member restrained from completely escaping through said outer aperture;

(d) a compression spring having a stepped axially extending exterior surface with a front narrow neck and a rear enlarged body, said compression spring sized and shaped to slidably fit and reciprocate within said stepped bore of said lock barrel; and (e) a center pin having an axially extending shaft with a front enlarged head, said shaft sized and shaped to coaxially and slidably fit within said front narrow neck of said compression spring, said front exterior narrow neck portion of said normally unretracted compression spring extending across and closing said inner aperture of each said passageway and thereby forcing each said locking member outwardly to its locking position, said front exterior narrow neck portion of said compression spring, when retracted, moving rearwardly across and opening said inner aperture of each said passageway thereby permitting each said locking member to move inwardly to its unlocking position;

(f) operation of an uathorized key inserted in said lock causing said compression spring to be rearwardly compressed, said enlarged head being maintained forwardly of said passageways, said rearwardly compressed compression spring and said forwardly maintained enlarged head cooperating to permit said locking members to fall to their inward unlocking position.

2. The barrel lock as claimed in claim 1 wherein each said locking member is a locking ball and said outer aperture of each said passageway has a small inwardly extending rim preventing said locking ball from completely escaping through said outer aperature.

3. The barrel lock as claimed in claim 1 wherein said rear enlarged body of said compression spring has a compressible open coiled rear end and a noncompressible close coiled central portion, said neck of said compression spring being close coiled.

4. The barrel lock as claimed in claim 1 including means for resistively holding said enlarged head in said front bore.

5. The barrel lock as claimed in claim 4 wherein said means for resistively holding said enlarged head is a friction producing compound within said front bore.

6. A barrel lock comprising:

(a) a hollow cylindrical lock barrel having a closed front end and an apertured rear end, said lock barrel having a stepped axially extending bore, a front bore of said stepped bore having a relatively small diameter and a rear bore of said stepped bore having a relatively large diameter;

(b) said stepped barrel bore having an annular shoulder forming the junction between said front bore and said rear bore;

(c) at least two radially extending passageways running from an outer aperture in the exterior surface of said said lock barrel to an inner aperture in said front bore of said lock barrel, and a locking member movably mounted in each said passageway, the outer aperture of each said passageway having a small inwardly extending peripheral rim preventing said locking member from completely escaping through said outer aperture;

(d) a compression spring having a stepped axially extending exterior surface with a front narrow neck; and (e) a center pin having an axially extending shaft with a front enlarged head, said shaft sized and shaped to coaxially and slidably fit within said front narrow neck of said main compression spring, the forward movement of said front narrow neck of said compression spring being limited by said enlarged head;

(f) said narrow neck of said normally unretracted compression spring extending forwardly across and closing said inner aperture of each said passageway and thereby forcing said locking members outwardly to their locking position, said compression spring being rearwardly compressed and said enlarged head being maintained in its position when an authorized key is fully inserted into said lock and operated, said rearwardly compressed compression spring and said forwardly maintained enlarged head cooperating to permit said locking balls to fall to their inward unlocking position.

7. The barrel lock as claimed in claim 6 wherein said locking member is a locking ball and said outer aperture of each said passageway has a small inwardly extending rim preventing said locking ball from completely escaping through said outer aperature.

8. The barrel lock as claimed in claim 7 wherein said compression spring has a compressible open coiled rear end and a noncompressible close coiled central portion, said neck of said main compression spring being close coiled.

9. The barrel lock as claimed in claim 8 including a friction producing compound within said front bore for maintaining said enlarged head in said front bore.

10. The barrel lock as claimed in claim 9 wherein said center pin shaft has a pointed rear end, said enlarged head moving rearwardly when an unauthorized key or pick is inserted and operated to retract and rearwardly compress said compression spring, said rearwardly positioned enlarged head maintaining said locking balls outwardly in their locking position.

11. A barrel lock comprising:

(a) a hollow cylindrical lock barrel having a closed front end and an apertured rear end, said lock barrel having a stepped axially extending bore, a front bore of said stepped bore having a relatively small diameter and a rear bore of said stepped bore having a relatively large diameter;

(b) said stepped barrel bore having an annular shoulder forming the junction between said front bore and said rear bore;

(c) at least two radially extending passageways running from an outer aperture in the exterior surface of said lock barrel to an inner aperture in said front bore of said lock barrel, and a locking member mounted in each said passageway for limited movement therein, said locking member restrained from completely escaping through said outer aperture;

(d) a compression spring extending axially in said stepped bore, said compression spring sized and shaped to slidably fit and reciprocate within said stepped bore, said compression spring having a compressible open coiled rear end, a noncompressible close coiled central portion, and a noncompressible close coiled front neck, said front neck adapted to normally engage and maintain said locking members in their locking position; and (e) a center pin extending axially in said stepped bore, said center pin having a front enlarged head and a rear pointed end, said enlarged head being positioned forward of said compression spring, said compression spring central portion adapted to be grasped internally and moved rearwardly by utilizing an authorized key insertable in said lock from said apertured rear end of said lock, actuation of the authorized key permitting said locking members to fall inwardly to their unlocking position.

12. The barrel lock as claimed in claim 11 wherein said enlarged head contacts said compression spring, said uncompressed compression spring and said enlarged head having a combined axial length which is greater than the axial length of said bore.

13. The barrel lock as claimed in claim 12 including a friction producing compound in said front bore for maintaining said enlarged head in said front bore when said compression spring is moved rearwardly by the authorized key.

* * * * *